US005245159A

United States Patent [19]

Chang

[11] Patent Number: 5,245,159

[45] Date of Patent: Sep. 14, 1993

[54] TRANSPARENT HOUSING FOR AN ELECTRIC HEAT CONVECTION STOVE

[76] Inventor: Kwei T. Chang, No. 14, Lane 54, Luong Chuan St., Panchiao, Taipei Hsien, Taiwan

[21] Appl. No.: 781,618

[22] Filed: Oct. 23, 1991

[51] Int. Cl.[5] ..... A21B 1/26; F27B 1/00

[52] U.S. Cl. ..... 219/400; 126/21 A; 99/330; 99/474

[58] Field of Search ..... 219/400, 385; 126/21 A, 126/21 R; 99/474, 473, 330, 340

[56] References Cited

U.S. PATENT DOCUMENTS

| | | | |
|---|---|---|---|
| 2,523,796 | 9/1950 | Weeks | 219/400 |
| 3,171,473 | 3/1965 | Lawler | 219/400 |
| 3,586,516 | 6/1971 | Terc | 219/400 |
| 3,735,091 | 5/1973 | Baker | 219/400 |
| 4,295,034 | 10/1981 | Assmann | 219/400 |
| 4,350,874 | 9/1982 | Nishikawa | 219/400 |
| 4,581,989 | 4/1986 | Swartley | 219/400 |
| 4,591,698 | 5/1986 | Chang | 219/400 |
| 4,817,509 | 4/1989 | Erickson | 219/400 |
| 5,047,610 | 9/1991 | Chang | 219/400 |
| 5,165,328 | 11/1992 | Erickson et al. | 219/400 |

FOREIGN PATENT DOCUMENTS 2254915 10/1982 United Kingdom .

*Primary Examiner*—Bruce A. Reynolds
*Assistant Examiner*—John A. Jeffery
*Attorney, Agent, or Firm*—Lowe, Price, LeBlanc & Becker

[57] ABSTRACT

An electric heat convection stove housing including a base, a stove body secured to said base at the top with a protective ring. A top cover is hingedly mounted to said protective ring for access to the interior of the stove body. The body includes a plurality of sets of heatproof plates connected face to face with a plurality of transparent glass plates respectively retained therebetween. The stove body has a plurality of grooves for mounting a grill at a desired level thereinside.

1 Claim, 5 Drawing Sheets

TRANSPARENT HOUSING FOR AN ELECTRIC HEAT CONVECTION STOVE

BACKGROUND AND SUMMARY OF THE INVENTION

The present invention relates to an electric heat-convection stove housing and relates more particularly to such an electric heat-convection stove housing which in transparent can be conveniently disassembled.

Regular heat-convection stoves are generally of fixed type, i.e. the parts of which can not be conveniently detached for replacement or repair. The present invention has been accomplished to eliminate this problem. It is therefore, an object of the present invention to provide an electric heat-convection stove which can be conveniently detached and re-assembled. In the preferred embodiment of the present invention, the stove body is comprised of a plurality sets of heat-proof plates connected face to face by screws with a plurality of transparent glass plates respectively retained therebetween. The stove body is secured to a base by screws, and the cover of the stove is pivoted to a protective ring which is secured to the stove body at the top by screws. The stove body has a plurality of grooves transversely spaced from one another for mounting a grill at the desired level.

DETAILED DESCRIPTION OF THE PREFERRED EMBODIMENT

Figure 1:
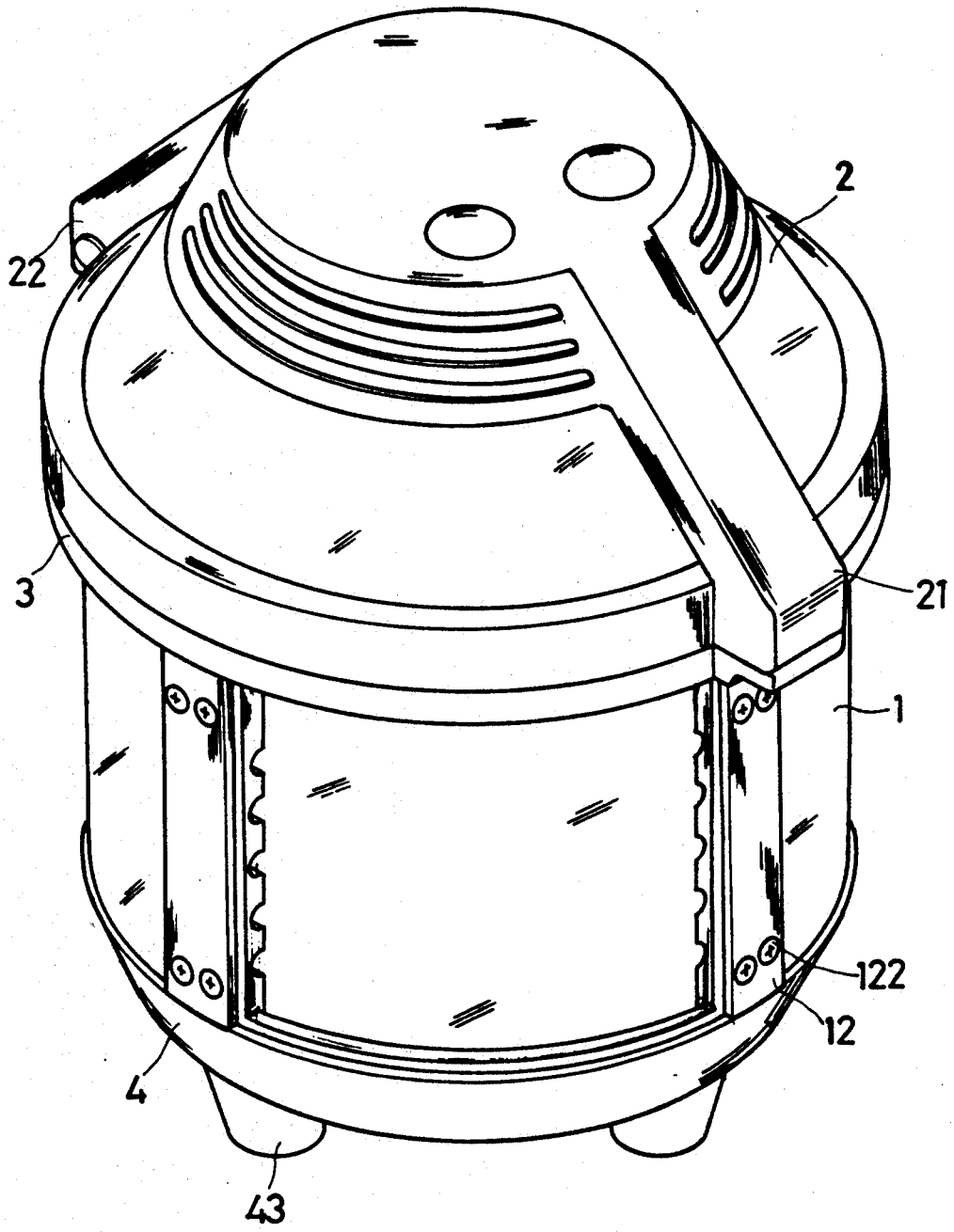
FIG. 1 is a perspective view of an electric heat-convection stove housing embodying the present invention.
Figure 2:
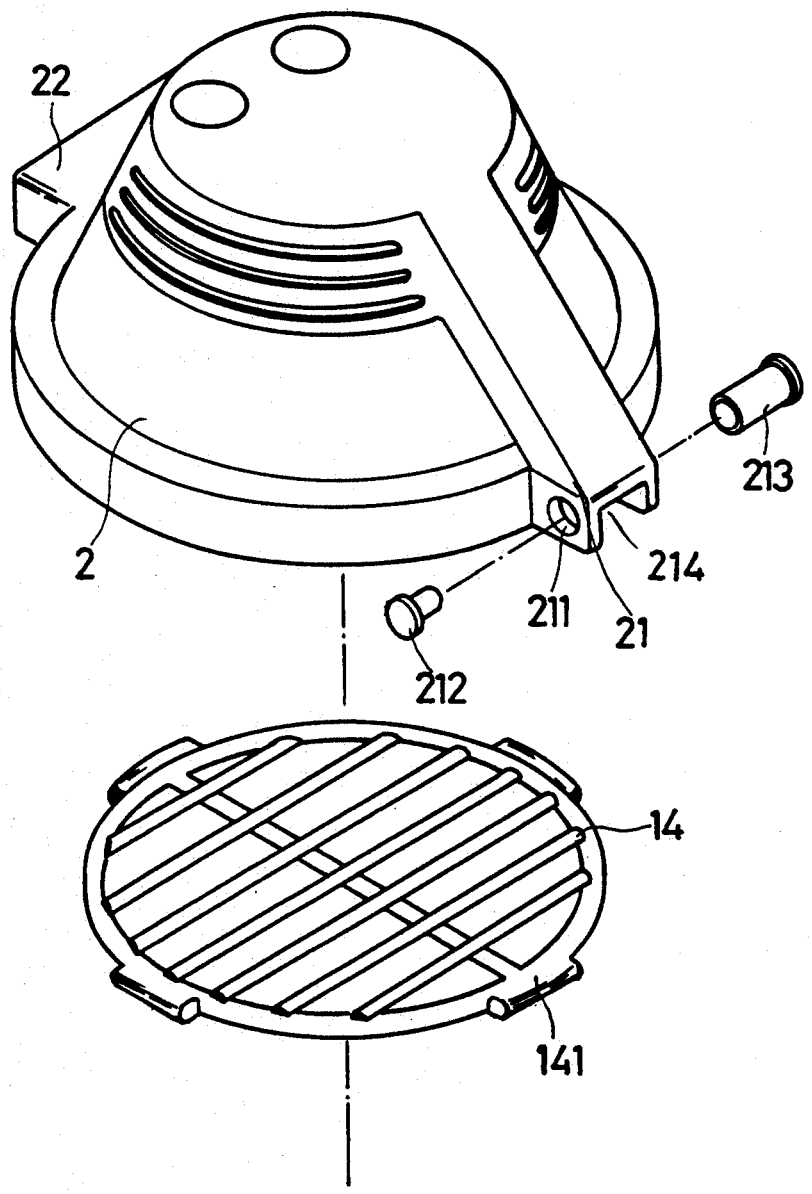
FIG. 2 is a dismantled perspective view of the cover thereof.
Figure 3:
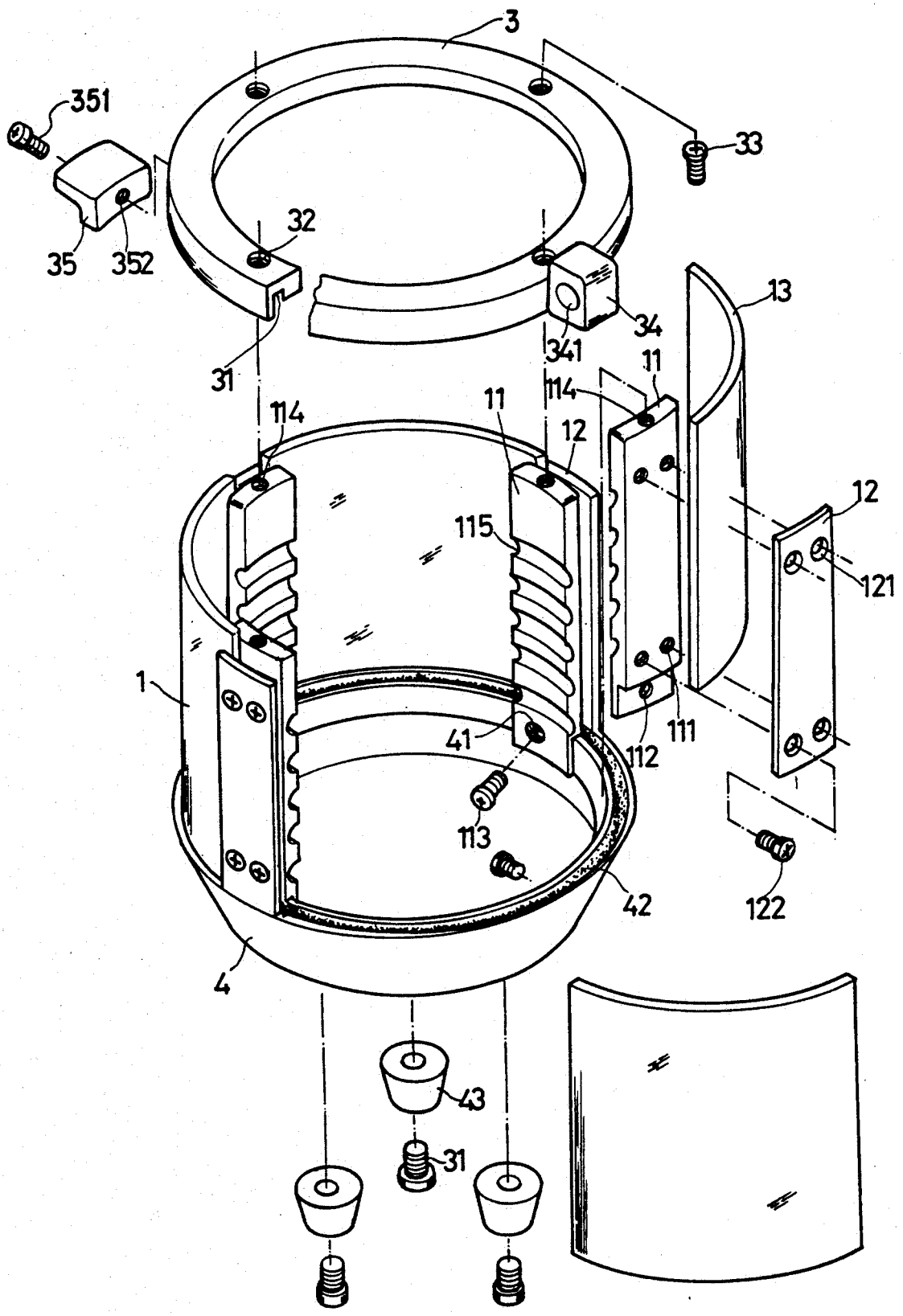
FIG. 3 is an exploded perspective view of the base, the body and the protective ring of the preferred embodiment of the present invention.
Figure 4:
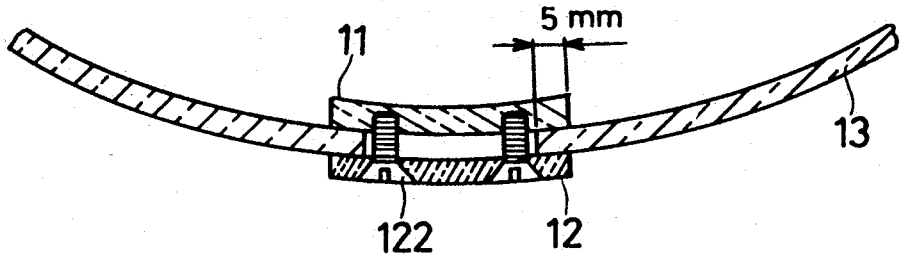
FIG. 4 is a cross section of the body thereof.
Figure 5:
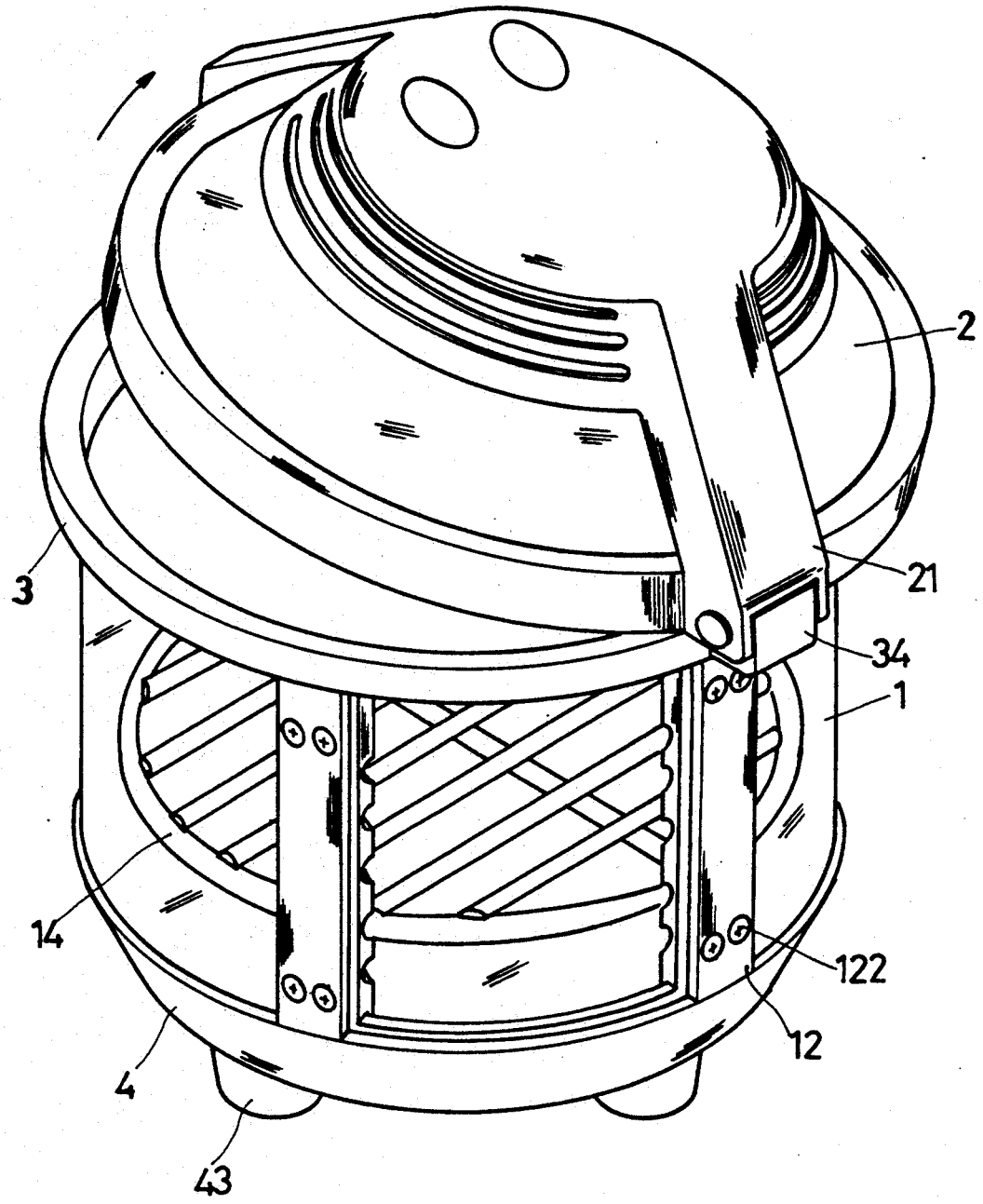
FIG. 5 is a perspective view illustrating the operation of the present invention.

Referring to the annexed drawings in greater detail, therein illustrated is the preferred embodiment of the electric heat-convection stove housing of the present invention, which is generally comprised of a stove body 1, a cover 2, a protective ring 3 and a base 4.

The stove housing body 1 is comprised of a plurality of inner heat-proof plates 11, outer heat-proof plates 12 and glass plates 13, and a grill 14. Each inner heat-proof plate 11 has two opposite pairs of bolt holes 111 transversely disposed at two opposite ends, a bolt hole 114 on the top edge thereof in longitudinal direction, a bolt hole 112 on the bottom end thereof in transverse direction, and a plurality of grooves 115 transversely spaced from one another on the inner wall surface thereof. Each outer heat-proof plate 12 has two opposite pairs of round holes 121 corresponding to the two opposite pairs of bolt holes 114 on each inner heat-proof plate 11. By inserting screws 122 through the two opposite pairs of round holes 121 on the outer heat-proof plates 12 into the two opposite pairs of bolt holes 111 on the inner heat-proof plates 11, the glass plates 13 are respectively retained therebetween. By inserting screws 113 through the round holes 112 on the inner heat-proof plates 11 into the bolt holes 41 on the base 4, the inner and outer heat-proof plates 11, 12 and the glass plates 13 are secured to the base 4. The grill 14 has a plurality of flanges 141 around the peripheral edge thereof. By engaging the flanges 141 in either groove 115 on each inner heat-proof plate 11, the grill 14 is mounted inside the stove body 1 at the desired level.

The cover 2 has a rib 21 obliquely extending downwards from the topmost edge thereof, which rib 21 has a notch 214 on the bottom end thereof for receiving a side block 34 on the peripheral edge of the protective ring 3 and two opposite round holes 211 at two opposite sides relative to said notch 214. By inserting a male fastening element 212 through one round hole 211 on the rib 21 and a round hole 341 on the side block 34 into the other round hole 211 on the rib 21 to secure with a female fastening element 213, the cover 2 is pivoted to the protective ring 3. The cover 2 further has a hand-hold portion 22 on the peripheral edge thereof through which it can be conveniently opened by the hand.

The protective ring 3 has a plurality of grooves 31 on the bottom edge thereof for fastening the glass plates 13, a plurality of bolt holes 32 on the top edge thereof through which screws 33 are screwed into the bolt holes 114 on the inner heat-proof plates 11 to secure the protective ring 3 to the stove body 1, a side block 34 having a round hole 341 for securing the cover 2 by a male fastening element 212 and a female fastening element 213, and a handle 35 secured to the peripheral edge thereof at a suitable location by a screw 351 which is screwed through a bolt hole 352 on said handle 35 and a bolt hole (not shown) on the peripheral edge of the protective ring 3.

The base 4 has an annular groove 42 around the peripheral edge thereof at the top for mounting the glass plates 13, a plurality of bolt holes 41 at suitable locations in transverse direction for inserting screws 113 to secure the inner heat-proof plates 11 thereto, and a plurality of cushion blocks 43 secured to the bottom edge thereof by screws 431.

During assembly process, the stove body 1 is set up at the first, then, the bottom edge of each glass plate 13 is inserted in the annular groove 42 on the base 4 at the top and the two opposite side edges thereof are respectively inserted in the gap between the adjacent heat-proof plates 11, 12. Then, insert screws through the bolt holes 112 on the inner heat-proof plates 11 into the bolt holes 41 on the base 4 to fixedly secure the stove body to the base 4. The protective ring 3 is then mounted on the stove body 1 at the top permitting the glass plates 13 to be respectively engaged in the grooves 31 on the bottom edge thereof, and then, screws 33 are respectively screwed through the bolt holes 32 on the protective ring 3 into the bolt holes 114 on the inner heat-proof plates 11 to firmly secure the protective ring 3 to the stove body 1. Once the protective ring 3, the stove body 1 and the base 4 are connected together, the cover 2 is attached to the protective ring 3 permitting the side block 34 to be engaged in the notch 214 of the rib 21 thereof, and then, fasten up the male and female fastening elements 212, 213 in the round holes 211 on the rib 21 and the round hole 341 on the side block 34 to secure the cover 2 to the protective ring 3 permitting the cover 2 to be pivoted thereto. At final, the grill 14 is placed inside the stove body 1 and engaged in either groove 115 on each inner heat-proof plate 11.

What is claimed is:

1. In an electric heat-convection stove including a base, a transparent stove housing mounted on the upper portion of said base, a protective ring mounted on said housing surrounding the topmost edge thereof, and a cover pivotally mounted on said protective ring at one end thereof, the improvement comprising:

said stove having a plurality of elongated, upstanding inner heat-proof frame plates, a plurality of elongated, upstanding outer heat-proof frame plates, a plurality of glass plates, and a grill, said inner heat-proof frame plates being respectively connected to said outer heat-proof frame plates face to face by screws with edges of said glass plates individually retained therebetween, said inner heat-proof frame plates each having a bolt hole on the top edge thereof, a projecting strip at the bottom secured to said base at an inner side by screws, and a plurality of grooves transversely disposed on the inner wall surface thereof for mounting a grill;

said protective ring having a plurality of grooves on the bottom edge thereof for receiving an edge of said glass plates and a plurality of bolt holes on the top edge thereof through which screws are screwed into the bolt holes in said inner heat-proof plates; and said base having an annular groove around the topmost edge thereof for receiving edges of said glass plates, and a plurality of bolt holes on the inner wall surface thereof for securing said inner heat-proof plates thereto by screws.

* * * * *